US007509781B2

(12) United States Patent
Veilleux et al.

(10) Patent No.: US 7,509,781 B2
(45) Date of Patent: Mar. 31, 2009

(54) STRUCTURAL WOODEN JOIST

(75) Inventors: Robert Veilleux, St-Victor (CA); Mario LaBrie, Beauceville Est (CA)

(73) Assignee: Romaro 2000 Limitee (CA)

( * ) Notice: Subject to any disclaimer, the term of this patent is extended or adjusted under 35 U.S.C. 154(b) by 925 days.

(21) Appl. No.: 09/836,310

(22) Filed: Apr. 17, 2001

(65) Prior Publication Data

US 2001/0039779 A1 Nov. 15, 2001

(30) Foreign Application Priority Data

Oct. 5, 2000 (CA) ..... 2322364

(51) Int. Cl.
*E04C 3/02* (2006.01)
*E04C 3/30* (2006.01)

(52) U.S. Cl. ..... 52/692; 52/837; 52/847

(58) Field of Classification Search ..... 52/729.4, 52/693, 650.1, 729.1, 730.7, 692, 837, 847
See application file for complete search history.

(56) References Cited

U.S. PATENT DOCUMENTS 3,651,612 A 3/1972 Schmitt
3,991,535 A * 11/1976 Keller et al. ..... 52/690
4,156,995 A 6/1979 Zusman
4,191,000 A * 3/1980 Henderson ..... 52/729.4
4,195,462 A * 4/1980 Keller et al. ..... 52/690
4,336,678 A * 6/1982 Peters ..... 52/729
4,435,929 A 3/1984 Bussell
4,550,674 A 11/1985 Zatek
5,109,898 A 5/1992 Schacht
5,267,425 A * 12/1993 Onysko et al. ..... 52/729.2
5,592,800 A 1/1997 Koo et al.
5,664,393 A * 9/1997 Veilleux et al. ..... 52/729.4
5,867,963 A 2/1999 Hershey ..... 52/729.4
6,308,469 B1 10/2001 Leung
6,318,499 B1 11/2001 Honein et al.

FOREIGN PATENT DOCUMENTS

DE 2649576 * 5/1978
GB 1367893 * 12/1970

* cited by examiner

*Primary Examiner*—Richard E Chilcot, Jr.
*Assistant Examiner*—Chi Q Nguyen
(74) *Attorney, Agent, or Firm*—Schwegman, Lundberg & Woessner, P.A.

(57) ABSTRACT

The structural wooden joist described comprises a lower chord, an upper chord spaced from the lower chord and a laminated panel structure joining the chords. This panel structure defines an uninterrupted surface from one end of the joist to an opposite end thereof and has opposite upper and lower edges joined to the lower and upper chords respectively. The laminated panel structure is formed of a series of elongated planks adhesively secured edgewise to one another and extending vertically between the lower and upper chords.

24 Claims, 1 Drawing Sheet

STRUCTURAL WOODEN JOIST

FIELD OF THE INVENTION

The present invention pertains to a structural wooden joist used in building constructions.

BACKGROUND OF THE INVENTION

Wooden joists are used increasingly in a number of building applications. They comprise top and bottom elongated chords with intervening struts joined to the chords by means of scarfing. One such wooden joist may be found described in U.S. Pat. No. 5,867,963 issued Feb. 9, 1999 to Hershey.

Some web structures have a triangular configuration such as the joist described in applicant's U.S. Pat. No. 5,664,393 issued Sep. 9, 1997.

In U.S. Pat. No. 4,336,678 issued Jun. 29, 1982, a wooden truss structure is described with a web member formed of sheet material, such as plywood.

OBJECTS AND STATEMENT OF THE INVENTION

It is an object of the present invention to provide a novel wooden joist which includes a laminated panel structure formed of short laminated vertical planks which are adhesively secured to one another by gluing thereby enabling an adjustment of the joist length at the building location by a simple sawing operation.

This type of joist is used in some cases for closing the peripheral areas of a floor or ceiling wherein all internal joists are the open type or, in other cases, as a fire barrier.

The present invention therefore relates to a structural wooden joist which comprises:

a) an elongated lower chord;

b) an elongated upper chord in a spaced apart opposed relation to the lower chord; and c) a laminated panel structure joining the chords and defining an uninterrupted surface from one end of the joist to an opposite end thereof and having opposite upper and lower edges joined to the lower and upper chords respectively; the laminated panel structure is formed of a series of elongated planks adhesively secured edgewise to one another and extending vertically between the lower and upper chords.

In one form of the invention, the laminated panel structure has a width equal to the width of the lower and upper chords thereby defining a continuous rectangular shaped cross-section throughout the length of the joist.

In another form of the invention, the laminated panel structure is formed of two laminated panels extending parallel to and abutting one another.

The boards are made of kiln dry wood, preferably one selected from the group that includes fir, spruce and pine.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
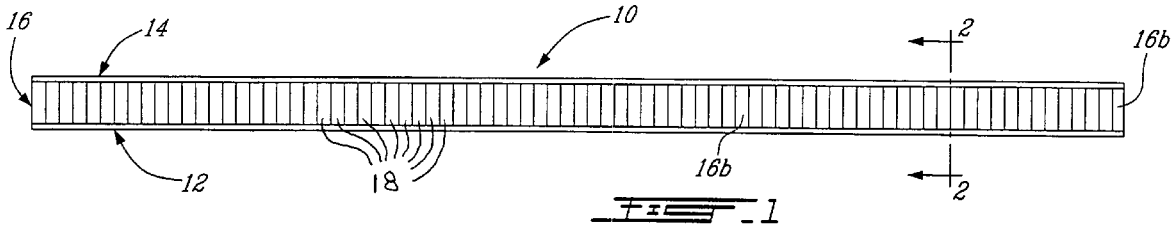
FIG. 1 is an elevational view of a wooden joist made in accordance with the present invention.

Referring to FIG. 1, there is shown a structural wooden joist, generally denoted 10, which comprises an elongated lower chord 12 and an elongated upper chord 14 in spaced apart generally parallel opposed relation to the lower chord 12.

Between the upper and lower chords, is provided a laminated panel structure 16 consisting of a series of vertically extending planks 18.

Figure 2:
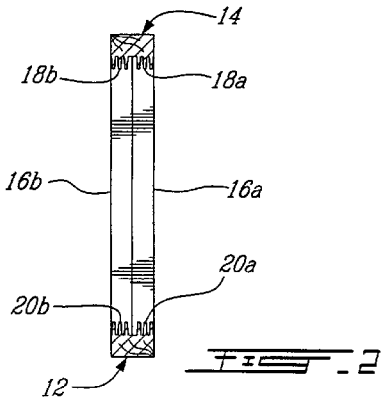
FIG. 2 is a cross-sectional view taken along lines 2-2 of FIG. 1.

In a first embodiment illustrated in FIG. 2, the laminated panel structure consists of two laminated panels 16*a* and 16*b* extending parallel to and abutting one another. Each panel 16*a*, 16*b* consists of a series of vertically extending planks 18 which are adhesively secured in edgewise fashion to one another. They are secured to one another by glue; however, they could also be secured by a V-shaped joint or similar joint.

The planks are joined in an endwise manner to the lower and upper chords by scarf joints 18*a*, 18*b* and 20*a*, 20*b*. Glue is used to secure the joints.

In embodiment illustrated in FIG. 2, the width of the chords 12 and 14 is substantially the same as that of the width of both panels 16*a* and 16*b* together thereby providing a continuous rectangular cross-section throughout the length of the joist.

Figure 3:
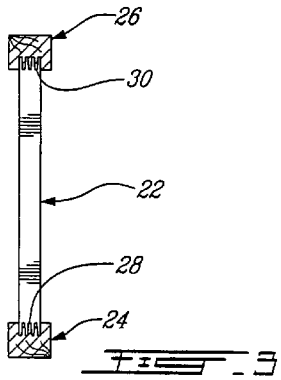
FIG. 3 is a cross-sectional view of another embodiment of the present invention.

In another embodiment of the invention (see FIG. 3), there is a single laminated panel 22 which is again formed of a series of adhesively secured vertical planks joined to a lower chord 24 and an upper chord 26 by finger joints 28 and 30.

Again, glue may be used to secure the planks together or V-shaped or similar joints.

The wood used for all planks of the panels is kiln dry wood preferably one selected from the group consisting of fir, spruce and pine. The wood fibers extend in the longitudinal direction of the plank.

Also, the glue used in securing the planks together as well as that used in the scarfing is one preferably having a base of resin resorcinol, such as phenol resorcinol resin, or one having a base of urethane, or one approved for structural wood.

Although the invention has been described above with respect to one specific form, it will be evident to a person skilled in the art that it may be modified and refined in various ways. For example, the opposite end regions of the joist may be sawed off to form inserts in a truss such as the one described for example in the above identified U.S. patent to Hershey. It is therefore wished to have it understood that the present invention should not be limited in scope, except by the terms of the following claims.

The invention claimed is:

1. A structural wooden joist adapted to be cut to form inserts in a truss comprising:

an elongated lower chord;

an elongated upper chord in a spaced apart opposed relation to said lower chord; and a laminated panel structure joining said chords; said laminated panel structure defining an uninterrupted surface from one end of the joist to an opposite end thereof and having opposite upper and lower edges joined to said lower and upper chords respectively; said laminated panel structure being formed of a series of elongated planks adhesively secured edgewise to one another with each elongated plank oriented with a longitudinal axis extending vertically between said lower and upper chords, the series of elongated planks including interior planks that are joined to two adjacent planks and end planks that are joined to one adjacent plank, wherein each of the interior elongated planks are secured along their longest edges to the adjacent planks, respectively, and wherein each of the interior elongated planks are secured along their shorter edges to the top chord and bottom chord, respectively;

wherein said joist is adapted to be cut at any length thereof to form an insert to block the ends of a truss between upper and lower chords of said truss; said upper and lower chords of said joist extending parallel to said upper and lower chords of said truss.

2. The structural joist as defined in claim 1, wherein said laminated panel structure is formed of two laminated panels extending parallel to and abutting one another, each said panel being formed of a series of elongated planks secured edgewise to one another.

3. The structural joist as defined in claim 1, wherein said panel is secured to said chords by more than two finger joints at each chord.

4. The structural joist as defined in claim 3, wherein said planks are adhesively secured to one another by means of a glue having a base of resin resorcinol.

5. The structural joist as defined in claim 1, wherein said planks are made of kiln dry wood.

6. The structural joist as defined in claim 5, wherein said wood is selected from the group including fir, spruce and pine.

7. The structural joist as defined in claim 1, wherein fibers in said planks extend generally perpendicular to said chords.

8. The structural joist as defined in claim 1, wherein said planks are joined to one another by a V-shaped joint.

9. A structural wooden joist for closing peripheral areas of a floor joist structure comprising:

an elongated lower chord having a given width;

an elongated upper chord in a spaced apart opposed relation to said lower chord and having a width equal to the width of said lower chord; and a laminated structure joining said chords; said laminated panel structure defining an uninterrupted surface having opposite lower and upper edges joined to said lower and upper chords respectively; wherein said laminated panel structure is formed of two laminated panels extending parallel to and abutting one another, each said panel being formed of a series of elongated planks secured edgewise to one another; said laminated panel structure having a width equal to the width of said lower and upper chords thereby defining a continuous rectangular shaped cross-section throughout the longitudinal direction of said joist, the series of elongated planks including interior planks that are joined to two adjacent planks and end planks that are joined to one adjacent plank, wherein each of the interior elongated planks are secured along their longest edges to the adjacent planks, respectively, and wherein each of the interior elongated planks are secured along their shorter edges to the top chord and bottom chord, respectively.

10. The structural joist as defined in claim 9, wherein said panel is secured to said chords by more than two finger joints at each chord.

11. The structural joist as defined in claim 10, wherein said planks are adhesively secured to one another by means of a glue having a base of resin resorcinol.

12. The structural joist as defined in claim 9, wherein said planks extend perpendicularly to said chords.

13. The structural joist as defined in claim 9, wherein said planks are made of kiln dry wood.

14. The structural joist as defined in claim 13, wherein said wood is selected from the group including fir, spruce and pine.

15. The structural joist as defined in claim 9, wherein fibres in said planks extend in the longitudinal direction of said planks.

16. The structural joist as defined in claim 9, wherein said planks are joined to one another by a V-shaped joint.

17. A structural wooden joist adapted to be cut to form inserts in a truss comprising:

an elongated lower chord;

an elongated upper chord in a spaced apart opposed relation to said lower chord; and a laminated panel structure joining said chords; said laminated panel structure defining an uninterrupted surface from one end of the joist to an opposite end thereof and having opposite upper and lower edges joined to said lower and upper chords respectively; said laminated panel structure being formed of a series of elongated planks adhesively secured edgewise to one another with each elongated plank oriented with a longitudinal axis extending vertically between said lower and upper chords, the series of elongated planks including a first dimension extending between the top chord and the bottom chord and a second dimension generally parallel to the top and bottom chord and perpendicular to the first dimension, and wherein the first dimension is greater than the second dimension, wherein said joist is adapted to be cut at any length thereof to form an insert to block the ends of a truss between upper and lower chords of said truss; said upper and lower chords of said joist extending parallel to said upper and lower chords of said truss.

18. The structural joist as defined in claim 17, wherein said laminated panel structure is formed of two laminated panels extending parallel to and abutting one another.

19. The structural joist as defined in claim 17, wherein said panel is secured to said chords by more than two finger joints at each chord.

20. The structural joist as defined in claim 19, wherein said planks are adhesively secured to one another by means of a glue having a base of resin resorcinol.

21. The structural joist as defined in claim 17, wherein said planks are made of kiln dry wood.

22. The structural joist as defined in claim 21, wherein said wood is selected from the group including fir, spruce and pine.

23. The structural joist as defined in claim 17, wherein fibers in said planks extend generally perpendicular to said chords.

24. The structural joist as defined in claim 17, wherein said planks are joined to one another by a V-shaped joint.

* * * * *